US008231194B2

(12) United States Patent
Kitami et al.

(10) Patent No.: US 8,231,194 B2
(45) Date of Patent: Jul. 31, 2012

(54) INKJET RECORDING APPARATUS

(75) Inventors: Akiko Kitami, Hino (JP); Kazuo Asano, Hino (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 331 days.

(21) Appl. No.: 12/608,221

(22) Filed: Oct. 29, 2009

(65) Prior Publication Data

US 2010/0118073 A1 May 13, 2010

(30) Foreign Application Priority Data

Nov. 7, 2008 (JP) ..... 2008-286249

(51) Int. Cl.
*B41J 29/38* (2006.01)

(52) U.S. Cl. ..... 347/10; 347/9; 347/11

(58) Field of Classification Search ..... 347/9–11
See application file for complete search history.

(56) References Cited

U.S. PATENT DOCUMENTS

| | | | |
|---|---|---|---|
| 2004/0155915 | A1 | 8/2004 | Kitami et al. |
| 2005/0237366 | A1 | 10/2005 | Kawabata et al. |
| 2007/0030297 | A1 | 2/2007 | Norigoe |

FOREIGN PATENT DOCUMENTS

| | | |
|---|---|---|
| JP | 11-268266 | 10/1999 |
| JP | 2004-82425 | 3/2004 |
| WO | WO 95/25011 A | 9/1995 |

OTHER PUBLICATIONS

Extended European Search Report dated Feb. 15, 2010 (8 pages), issued in counterpart European Application U.S. Appl. No. 09252499.0.

*Primary Examiner* — Jason Uhlenhake
(74) *Attorney, Agent, or Firm* — Holtz, Holtz, Goodman & Chick, PC

(57) ABSTRACT

An inkjet recording apparatus including: a recording head having a pressure chamber, and a pressure generation device to change a volume of the pressure chamber, wherein the recording head ejects an ink in the pressure chamber as an ink droplet from a nozzle by driving the pressure generation device based on drive signals; and a drive signal generating section to generate the drive signals, which include: an ejection pulse including a first pulse for expanding the volume of the pressure chamber and then contracting the volume; a preliminary pulse, to be applied immediately before the first pulse, for contracting the volume of the pressure chamber and then expanding the volume, and wherein the preliminary pulse is a rectangular wave having a pulse width of 2AL or greater, where AL is ½ of an acoustic resonance cycle period of a pressure wave in the pressure chamber.

8 Claims, 12 Drawing Sheets

INKJET RECORDING APPARATUS

CROSS REFERENCE TO RELATED APPLICATION

The present application is based on Japanese Patent Application No. 2008-286249 filed with Japanese Patent Office on Nov. 7, 2008, the entire content of which is hereby incorporated by reference.

BACKGROUND OF THE INVENTION

1. Field of the Invention

This invention relates to an inkjet recording apparatus.

2. Description of Related Arts

In an inkjet apparatus, in order to realize a high quality recording, the ink dot diameter needs to be made small. As a method of reducing the recording dot diameter, it is conventionally known to utilize a "pull-push driving" system where a pressure chamber communicating to a nozzle opening is contracted after temporarily expanded {(please refer to Unexamined Japanese Patent Application Publication HEI11-268266 (JPA1999-268226), and Unexamined Japanese Patent Application Publication 2004-82425 (JPA2004-82425)). According to this system, the mass of each ink droplet can be reduced, and the recording dot diameter can be minified.

In JPA1999-268226 and JPA2004-82425 a method is disclosed where after an ink meniscus is once pushed-out by a contraction pulse, the meniscus is drawn deeply into a nozzle, and thereafter a droplet is ejected, according to the "pull-push driving" system.

As the recording heads utilizing piezoelectric elements as pressure generation devices, there are: a system of applying a vibration plate described in JPA1999-268226 (for example, a laminated piezoelectric layer method, and a deflection mode method), and a shear deformation system where a partition wall of a pressure chamber is shear deformed, but not using the vibration plate.

Drive signals described in JPA1999-268226 and JPA2004-82425 require an analogue circuit for utilizing a slope waveform as a contraction pulse to push-out the meniscus, which complicates the configuration of the drive circuit. Further, since this method requires a relatively long drive period, drive frequency is difficult to be increased.

In the laminated piezoelectric layer method, which changes the volume of the pressure chamber via the vibration plate, described in JPA1999-268226, since the piezoelectric element is disposed outside the pressure chamber, the shape and size of the piezoelectric element is not so much restricted, and it is possible to generate high pressure by using a powerful piezoelectric element, thus this method is good at ejection capability and ejection control of the ink droplet. However, the structure of such an inkjet head becomes complicated, manufacturing of a large capacity head is difficult, and a head having about 100 channels may be a limit.

In contrast, since the head of shear deformation mode system, described in JPA2004-82425, has a simple structure where grooves are formed to be pressure chambers in a piezoelectric element, a large capacity head having several hundred channels is possible to be manufactured. However, especially in the cases where drive signals of a rectangular pressure wave are applied to the recording head of shear mode system, ejection of a minute droplet is difficult due to the influence of pressure wave vibration in the pressure chamber.

In the recording head utilizing a piezoelectric element as a pressure generation device, particularly in the recording head of a shear mode system, in order to effectively draw-in the meniscus position before ejection and to eject a minute droplet while suppressing the generation of pressure waves by using a rectangular wave as the contraction pulse for pushing-out the meniscus, it is necessary to devise an improved drive method.

An objective of the present invention is to provide an inkjet recording apparatus provided with a recording head capable of stably ejecting a minute droplet by utilizing a rectangular wave which is possible to simplify the drive circuit.

SUMMARY

An inkjet recording apparatus or method reflecting an aspect of the present invention has following configurations:

(1) An inkjet recording apparatus including:

a recording head having a pressure chamber, and a pressure generation device to change a volume of the pressure chamber, wherein the recording head ejects an ink in the pressure chamber as an ink droplet from a nozzle by driving the pressure generation device based on drive signals; and a drive signal generating section to generate the drive signals to be applied to the pressure generation device, wherein the drive signal generating section generates the drive signals which includes:

an ejection pulse including a first pulse for expanding the volume of the pressure chamber and then contracting the volume;

a preliminary pulse, to be applied immediately before the first pulse, for contracting the volume of the pressure chamber and then expanding the volume, and wherein the preliminary pulse is a rectangular wave having a pulse width of 2AL or greater, where AL is ½ of an acoustic resonance cycle period of a pressure wave in the pressure chamber.

(2) The inkjet recording apparatus of (1), wherein the pulse width of the preliminary pulse is not less than 3.5AL and not greater than 6AL.

(3) The inkjet recording apparatus of (1), wherein the ejection pulse further includes a second pulse, which is to be applied after 1AL time period from the first pulse, for expanding the volume of the pressure chamber after first contracting the volume.

(4) The inkjet recording apparatus of (3), wherein when the ink droplet is not to be ejected, the pressure generating device of the pressure chamber is applied the preliminary pulse and/or the second pulse to cause a micro-vibration in an ink meniscus in the nozzle not to an extent of ejecting the ink droplet from the nozzle.

(5) An inkjet recording method for utilizing a recording head having a pressure chamber and a pressure generation device to change a volume of the pressure chamber, and ejecting an ink in the pressure chamber as an ink droplet from a nozzle by driving the pressure generation device, the method including the steps of:

applying, to the pressure generation device, an ejection pulse including a first pulse for expanding a volume of the pressure chamber and then contracting the volume; and applying, to the pressure generation device, a preliminary pulse immediately before the first pulse, for contracting the volume of the pressure chamber and then expanding the volume, wherein the preliminary pulse is a rectangular wave having a pulse width of 2AL or greater, where AL is ½ of an acoustic resonance cycle period of a pressure wave in the pressure chamber.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Examples of preferred embodiments of the present invention will now be described with reference to the drawings, however the embodiment of the present invention is not restricted to the examples.

Figure 1:
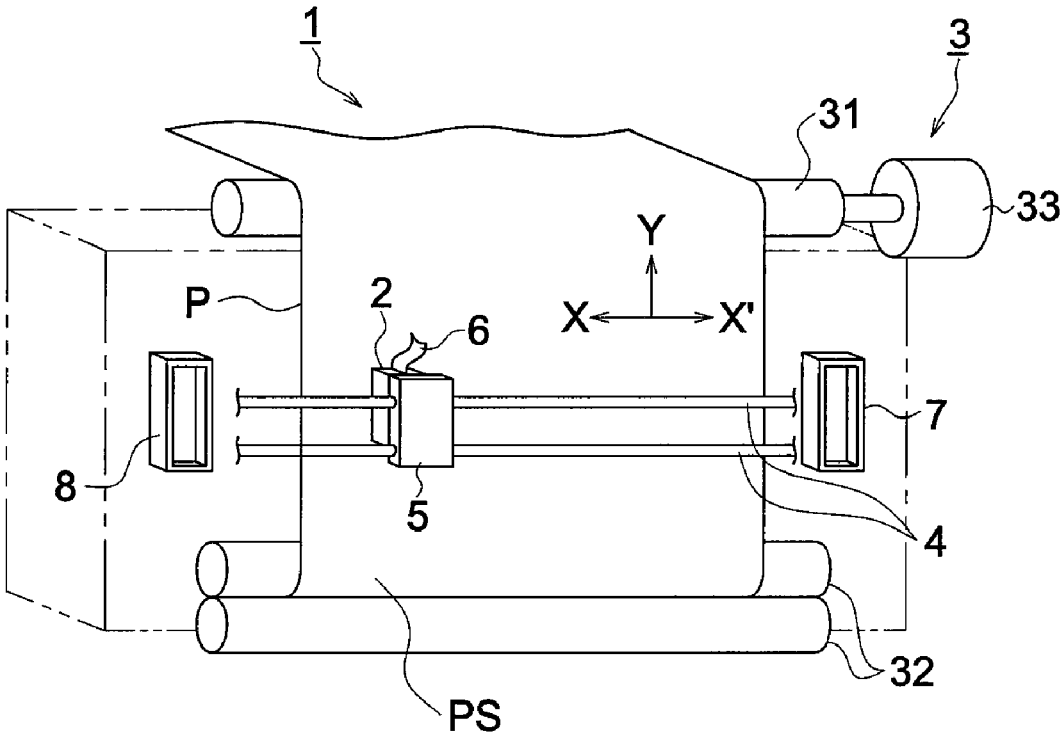
FIG. 1 is a schematic configuration of an ink jet recording apparatus.

FIG. 1 shows a schematic configuration of an ink jet recording apparatus. In ink jet recording apparatus 1, recording medium P is held securely by paired conveying rollers 32 of conveying mechanism 3 and conveyed in the arrowed Y direction by conveying roller 31, which is driven to rotate by conveying motor 33.

Recording head 2 of shear mode system is provided between conveying roller 31 and paired conveying rollers 32 with the head facing recording surface PS of recording medium P. Recording head 2 is mounted on carriage 5 which can move reciprocally along guide rails 4 provided across recording medium P, in the X-X' direction (or main scanning direction) which is basically perpendicular to the movement of recording medium P (sub scanning direction) by a driving unit (which is not shown in the drawings) with the nozzle side of the head facing recording surface PS of recording medium P. An electrode (not illustrated) formed on each separation wall of each pressure chamber is electrically connected to drive-signal generating section 100 (see FIG. 3), which includes a circuit to generate an ejection pulse, and a preliminary pulse mentioned below, through flexible cable 6.

Recording head 2 records a requested inkjet image by ejecting ink droplets while moving in the X-X' direction over recording surface PS of recording medium P due to the movement of carriage 5.

In FIG. 1, ink receiver 7 is provided outside the image recording area, namely in a standby position such as a home position of recording head 2 so that recording head 2 may discharge a little quantity of ink into ink receiver 7 while the recording head is not recording, in order to refresh the ink of increased viscosity at the nozzle opening. A cap (not shown in drawings) is provided to cover the nozzle surface of recording head 2 for protection while recording head 2 stays long time in the standby position. Another ink receiver 8 is provided opposite to ink receiver 7 with recording medium P between ink receivers 7 and 8. Ink receiver 8 is used to receive ink discharged when the recording head reverses the moving direction.

As described above, as the ejection of ink droplet of the present embodiment, there are the ejection for recording images, and the ejection for discharging ink at outside the image recording area to refresh the ink. In the present embodiment, the ink meniscus in the nozzle is given micro-vibrations to the extent of not ejecting an ink droplet from the nozzle, at the time of non-ejection, namely while not ejecting the ink droplet.

Here, the image recording area is an area for which, image data is supplied to the recording head, and based on the image data ink droplets are ejected from the nozzles of the recording head to execute the image recording. For example, in a case of recording anywhere on an page of A4-size paper as the recording medium, the entire face of A4-size paper is the image recording area.

Here, the area outside of image recording area is that for which image data are basically not supplied to the recording head, and no ink droplet is ejected based on the image data from any of all the nozzles. Further, a non-ejection pixel is referred to as a pixel for which ink droplet ejection is not conducted in the image recording area.

Since a liquid ink for inkjet contains coloring material and polymer and the like, just by stopping the ejection for a short period, for example several seconds, a very slight amount of water or solvent is evaporated from the nozzle opening, which causes formation of a covering layer to increase the viscosity of the liquid ink. Due to this, even during a very short period of stopping the ejection, clogging of the nozzle may easily result.

Therefore, according to the present embodiment, while not ejecting the ink droplet, by giving micro-vibrations to the ink meniscus in the nozzle to the extent of not ejecting any ink droplet from the nozzle, the ink in the nozzle is effectively agitated, and stable ejection of the ink droplet is enabled, which exhibiting highly improved decap property, even in low temperature and low humidity circumstances.

Wherein, the decap property is assumed to be expressed by the amount of decreased initial ejection speed due to so called decap phenomenon which is caused by an increase of ink viscosity due to drying of the ink meniscus in case of nozzle surface has been left open.

Figure 2A:
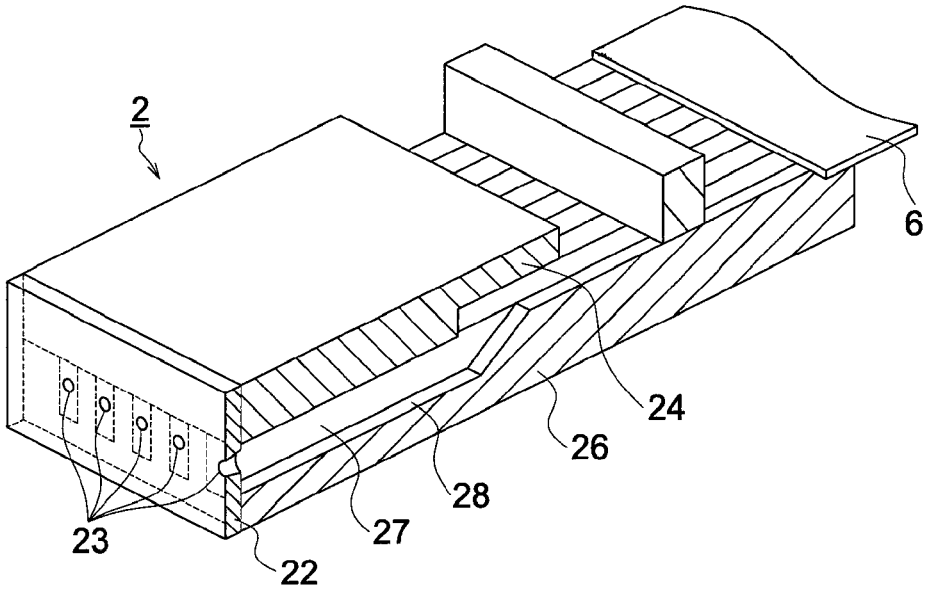
FIG. 2*a* is an oblique perspective view and FIG. 2*b* is a sectional view showing an example of a recording head.
Figure 2B:
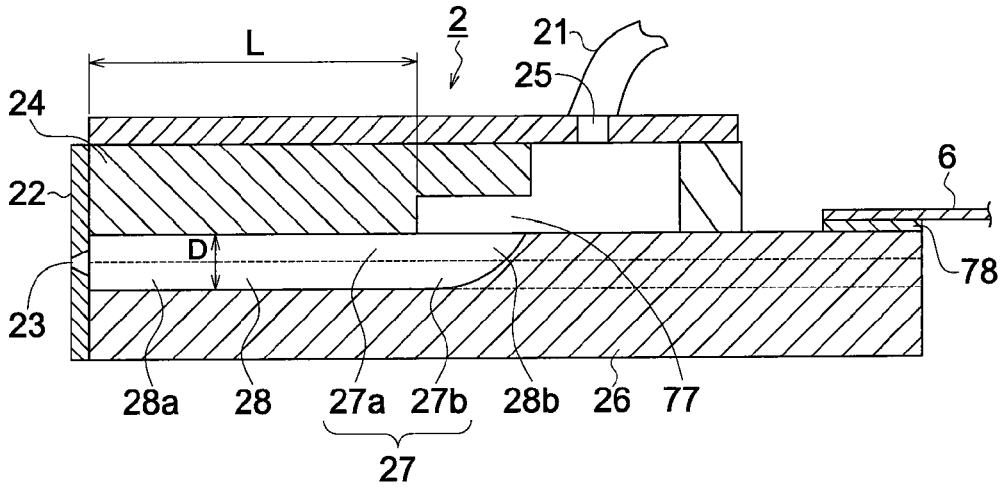
Figure 3A:
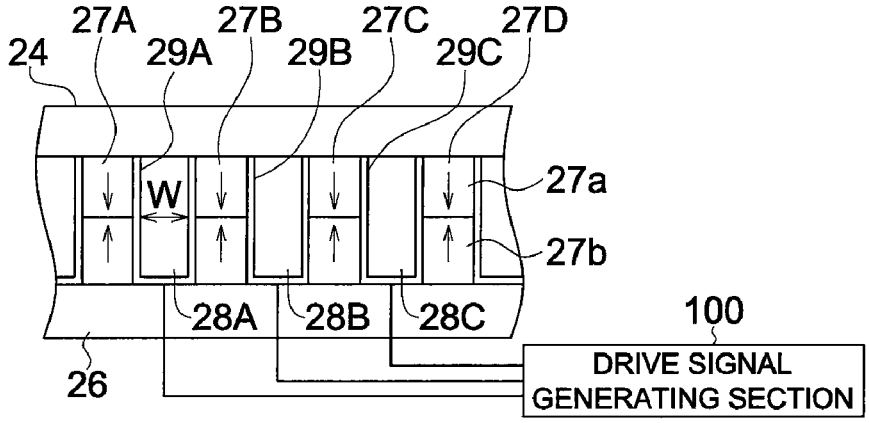
FIGS. 3*a* to 3*c* show ejection operations of the recording head.
Figure 3B:
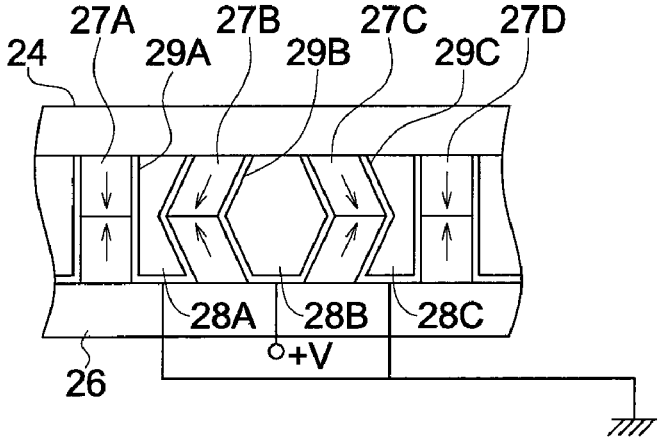
Figure 3C:
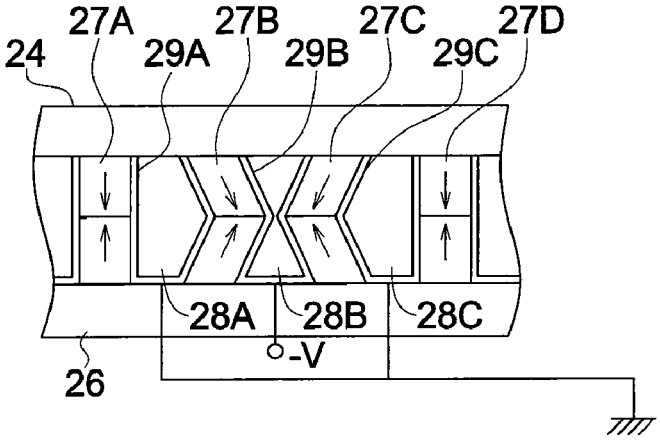

FIGS. 2*a* and 2*b* show a schematic configuration of a shear-mode ink jet recording head 2. FIG. 2*a* is an oblique perspective view, while FIG. 2*b* is a sectional view of the shear-mode ink jet recording head. FIGS. 3*a*-3*c* are drawings showing the operation at ejecting ink. Individual items in FIGS. 2*a*-2*b* and FIGS. 3*a*-3*c*, are: recording head 2, ink tube 21, nozzle forming member 22, nozzles 23, cover plate 24, ink supply port 25, substrate 26, partition wall 27, and length L, depth D, and width W of the pressure chamber. Pressure chamber 28 is configured of partition wall 27, cover plate 24, and substrate 26.

As shown in FIGS. 3*a*-3*c*, recording head 2 is a shear-mode type recording head which contains multiple pressure chambers 28 partitioned by partition walls 27A, 27B, 27C, and 27D made of piezoelectric material such as PZT which works as a pressure generation device, arranged between cover plate 24 and substrate 26. Among said multiple pressure chambers 28, FIG. 3*a*-*c* show three pressure chambers, namely 28A, 28B, and 28C. One end of pressure chamber 28 (sometimes called "a nozzle end") is connected to nozzle 23 which is formed in nozzle forming member 22. The other end of pressure chamber 28 (sometimes called "a manifold end") is connected to an ink tank (not shown in the drawings) with ink tube 21 via ink supply port 25. Each surface of the partition wall 27 in each pressure chamber 28 has an electrode (29A, 29B, or 29C) tightly bonded to both sides. Each said electrode extends from the top of partition wall 27 to the bottom of substrate 26 and is connected to drive signal generating section 100 through flexible cable 6.

Each pressure chamber 28 contains a deeper section 28*a* at the exit side (left side in FIG. 2*b*) of the chamber and a shallow section 28*b* which becomes shallower towards the entrance side (right side in FIG. 2*b*) of the chamber.

In the case where the head is configured with a piezoelectric material that deforms under shear mode as described in the present embodiment, a rectangular wave (to be described later) can be effectively utilized, and the drive voltage can be reduced to enable more effective drive of the head.

Drive signal generating section 100 is configured with a drive signal generation circuit which generates a series of drive pulses including a plurality of drive pulses for each pixel cycle, and a drive pulse selection circuit which selects, for each pressure chamber, a drive pulse based on the image data of each pixel out of the drive signals supplied from the drive signal generation circuit. And, drive signal generating section 100 outputs a drive pulse, according to the image data of each pixel, to drive partition wall 27 of the pressure generation device. Said drive pulse includes a preliminary pulse and an ejection pulse.

Upon receiving the image data, the control section (not illustrated) respectively controls a motor to drive conveyance rollers and a drive unit of the carriage, and allows the drive signal generation circuit to generate a drive pulse, including at least a preliminary pulse and an ejection pulse. Further, the control section outputs information of the drive pulse to be selected, to the drive pulse selection circuit, based on the image data. Thus, based on said information, the drive pulse selection circuit selects and applies the drive pulse to partition wall 27. By this process, an ink droplet can be ejected during each pixel cycle, from nozzle 23 of recording head 2.

In the embodiment, each partition wall 27 is configured with two piezoelectric materials 27*a* and 27*b*, each having different polarizing directions as shown in FIGS. 3*a*-3*c*. However, the piezoelectric material can be structured, for example, with only a portion indicated by 27*a*, and can function if disposed on at least a part of partition wall 27.

In the present invention, it is characterized that the drive signal includes: an ejection pulse including a first pulse to contract a volume of the pressure chamber after expanding the volume; and a preliminary pulse, to be applied just before the first pulse, for expanding the volume of the pressure chamber after contracting the volume, and wherein the preliminary pulse is a rectangular wave having a pulse width of 2AL.

Wherein, AL (Acoustic Length) is ½ of the acoustic resonance cycle period of a pressure wave in the pressure chamber. "Pulse width" is defined as the interval between the point of 10% voltage in the rise from the start and the point of 10% voltage in the fall from the pulse-height voltage. AL can be obtained as a pulse width which maximizes the ejection velocity of ink droplets when the pulse width of rectangular pulses is varied with the rectangular pulse voltage kept constant in measurement of the ejection velocities of ink droplets which are ejected by applying rectangular pulses to partition wall 27 which is a pressure generation device. Further, "rectangular wave" means a waveform whose rise and fall time period of respectively to 10% and 90% of the drive voltage are within ½ of AL and preferably within ¼.

Further the time "immediately before" means the time range before the application of the ejection pulse wherein the application of preliminary pulse affects to reduce the droplet size, in the ink droplet ejection by the ejection pulse subsequent to the application of the preliminary pulse.

Figure 10A:
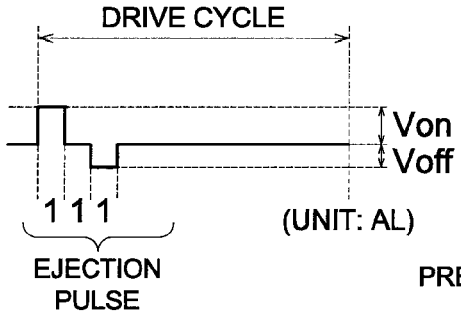
FIG. 10*a* shows a drive pulse having only the ejection pulse in a comparative example.
Figure 10B:
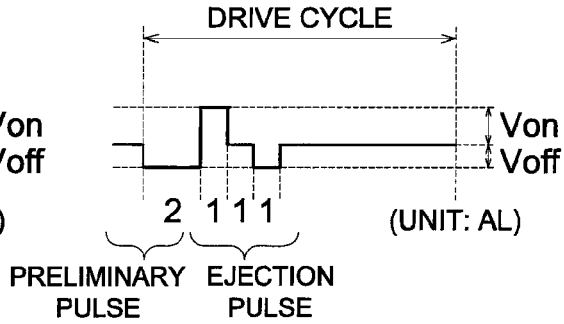
FIGS. 10*b*-10*f* show a set of a preliminary pulse and an ejection pulse of the present invention.
Figure 10C:
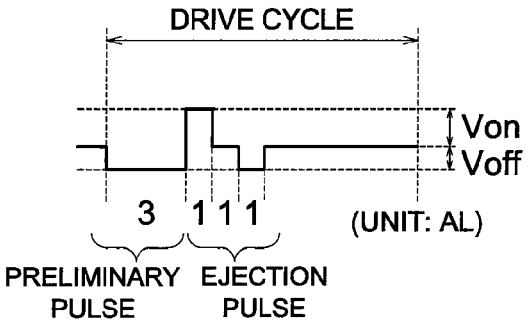
Figure 10D:
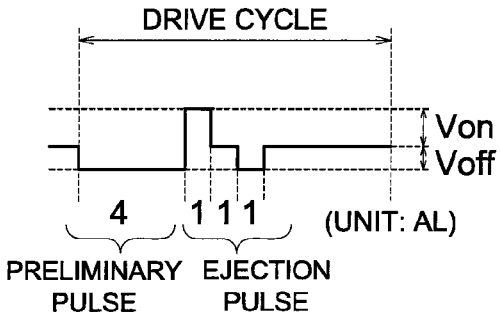

FIG. 10*d* shows an example of a drive signal of the present invention. In this example, the drive pulse is configured with a preliminary pulse and an ejection pulse, each being a single type of drive pulse.

When by the control of drive signal generating section 10, applied to electrodes 29A-29C formed in close contact on each partition wall 27 are pulses, shown in FIG. 10*d*, of an ejection pulse configured of a first pulse with drive voltage (wave height) Von of a positive voltage and pulse width 1AL, and a second pulse, to be applied after 1AL period from the first pulse, having drive voltage (wave height) of Voff of negative voltage and a pulse width of 1AL; and a preliminary pulse, to be applied immediately before the ejection pulse, having drive voltage (wave height) of Voff of negative voltage and a pulse width of 4AL. Thus, an ink droplet is ejected from nozzle 23 by the operations exemplified below. Each of the first pulse, the second pulse and the preliminary pulse is a rectangular wave. In FIGS. 3*a*-3*c*, nozzles are omitted.

Firstly, when no drive pulse is applied to any of electrodes 29A, 29B, and 29C, non of separation walls 27A-27C is deformed. In the status of FIG. 3(*a*), electrodes 29A and 29C are electrically grounded and a preliminary pulse is applied to electrode 29B, caused is an electric field perpendicular to the direction of polarization of piezoelectric materials 27*a* and 27*b* which constitute partition walls 27B and 27C. This causes a shearing deformation in the jointed surface of partition walls of piezoelectric materials 27*a* and 27*b*. Consequently, as shown in FIG. 3(*c*) partition walls 27B and 27C both deform inward to decrease the volume of pressure chamber 28B and thereby generate positive pressure in pressure chamber 28B. As the result, ink meniscus formed with a part of ink filled in pressure chamber 28B moves toward the direction of being pushed out from the nozzle. Said positive pressure is however not so high as to eject an ink droplet from the nozzle, therefore, no ink droplet is ejected from the nozzle at this stage.

After that, the potential is returned to 0 to make partition walls 27B and 27C return from the contraction positions shown in FIG. 3*c* to the neutral positions shown in FIG. 3*a*. Successively the first pulse is applied to deform partition walls 27B and 27C in directions reverse to each other as shown in FIG. 3*b*, to cause the volume of pressure chamber 28B to expand rapidly and to generate a large negative pressure in pressure chamber 28B. Due to this, the ink meniscus having been pushed out from the nozzle is drawn largely into the nozzle.

After that, when the potential is returned to 0, partition walls 27B and 27C return from the expansion positions as shown in FIG. 3*b* to the neutral positions as shown in FIG. 3*a*, to generate a positive pressure in pressure chamber 28B. Due to this action, a part of the ink meniscus having been largely drawn into the nozzle is pushed out from the nozzle, and after that separated from the meniscus, and ejected as a minute ink droplet.

Further, after the period of 1AL the second pulse is successively applied to deform partition walls 27B and 27C inward with each other to decrease the volume of pressure chamber 28B and generate a positive pressure in pressure chamber 28B, which cancels the reverberation of the pressure wave in pressure chamber 28B.

After that, when the potential is returned to 0, partition walls 27B and 27C return from the contraction positions as shown in FIG. 3*c* to the neutral positions as shown in FIG. 3*a*, to generate negative pressure in pressure chamber 28B, which cancels the reverberation of the pressure wave in pressure chamber 28B. Each of the other pressure chambers operates similarly to the above described mode by application of the preliminary pulse and the ejection pulse.

As described above, the preliminary pulse is a non-ejection pulse which does not by itself make the ink droplet eject from the nozzle. In the present embodiment, drive voltage Von of the first pulse and drive voltage Voff of the preliminary pulse are set to be: $|Von|>|Voff|$.

The preliminary pulse is placed in head of drive signals to eject a single ink droplet, and contracts the pressure chamber to the condition of not reaching the state to allow ejection of an ink droplet. The first pulse is applied successively to the preliminary pulse, and ejects a minute droplet after largely drawing the ink meniscus into the nozzle. The second pulse cancels the pressure wave reverberation by generating a pressure wave of a reverse phase to the first pulse, after the first pulse. By this action, even with a short drive cycle with high drive frequency, stable ejection of minute droplets can be realized.

Further, by applying a preliminary pulse having the pulse width of 2AL or more (AL is ½ of an acoustic resonance cycle period of the pressure wave in the pressure chamber), and the preliminary pulse being a rectangular wave which is possible to simplify the drive circuit to the recording head of shear mode system, it is enabled to largely draw the meniscus position into the nozzle and to eject a minute droplet while suppressing the influence of pressure wave reverberation in the pressure chamber.

The reason for the above phenomenon is assumed such that since the positive pressure wave, generated by contraction at the start of applying the preliminary pulse, decays as the elapse of time in the course of propagation in the pressure chamber, by quitting the application of the preliminary pulse and starting of the first pulse application to expand the pressure chamber after waiting the decay of the pressure wave for 2AL or more, it is enabled to largely draw the meniscus position into the nozzle and to eject a minute droplet while suppressing the influence of pressure wave reverberation in the pressure chamber.

Further, a rectangular wave enables a shorter drive pulse length compared to a trapezoidal wave or the like, even when the preliminary pulse of said rectangular wave is incorporated in the drive pulse, printing speed of the inkjet recording device is not significantly reduced. Further, since rectangular waves are easily formed by the use of simple digital circuits, the circuit structure for the drive pulse can be advantageously simplified, compared to the trapezoidal wave.

Further by using a rectangular wave as the ejection pulse, all of the drive pulses can be structured of only rectangular pulses and the drive circuits can be further simplified. Furthermore, the effect of reducing the drive voltage can also be attained.

Figure 5:
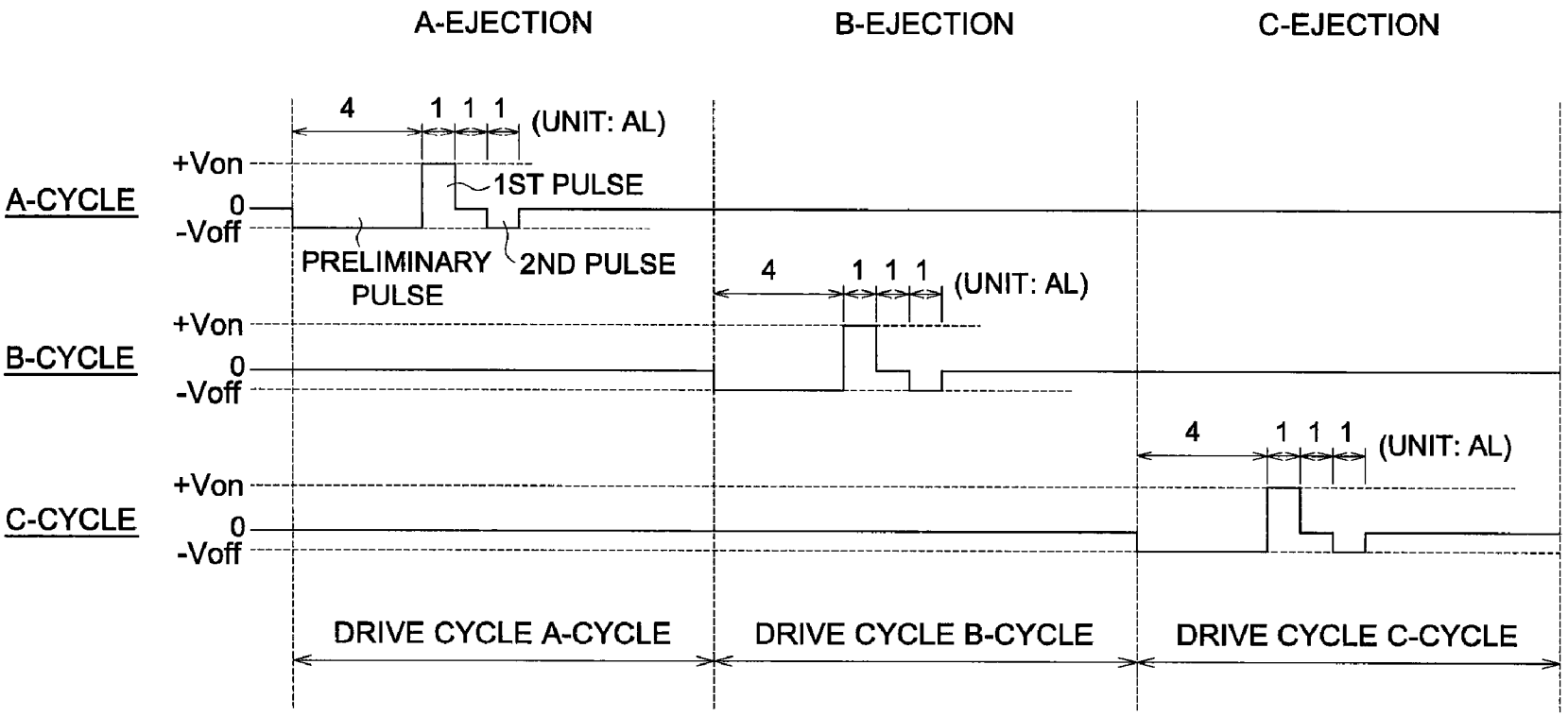
FIG. 5 shows a timing diagram of drive signals to be applied to pressure chambers of each groups A, B, and C.

In the example shown in FIG. 5, the relationship between drive voltage Von of the first pulse and drive voltage Voff of the second pulse is preferably $|Von|>|Voff|$. The drive voltages in the relationship of $|Von|>|Voff|$ are effective, especially in the case of ejecting high viscosity ink, for accelerating the return to the steady state of the ink meniscus in the nozzle after ejection, and enables stable high speed ejection, which is a preferable embodiment. Further, this embodiment enhances a droplet downsizing effect by the "pull-push driving" action, and as well enhances cancelling effect by the second pulse. Basic voltages of the drive voltage Von and drive voltage Voff are not necessarily zero. Drive voltage Von and drive voltage Voff are respectively voltage differences from the basic voltage. Further, due to reasons similar to those described above, the relationship of $|Von|/|Voff|=2$ is more preferable.

Further, the voltage of the preliminary pulse is set to be identical to the drive voltage Voff of the second pulse. This is preferable in that the number of kinds of power source voltages can be reduced in drive signal generating section 10, to generate the ejection pulse and the preliminary pulse, whereby manufacturing cost of the circuit can be reduced.

In the case of driving recording head 2 containing multiple pressure chambers 28 which are partitioned by partition walls 27, each of which is at least partially made of piezoelectric materials, when one of pressure chambers 28 works to eject ink, the neighboring pressure chambers 28 are affected. To prevent this, the multiple pressure chambers 28 are usually grouped into two or more groups, each of the groups including pairs of pressure chambers sandwiching one or more pressure chambers of the other group. These pressure chamber groups are controlled in sequence to eject ink in a time-division manner.

For example, in case of outputting a solid image by using all pressure chambers 28, a 3-cycle driving method is utilized where pressure chambers of every three pressure chambers configure a group of three groups, and each group of pressure chambers 28 is driven for ejection by the 3-cycle driving method. As another configuration of pressure chambers 28, there can be a method where pressure chambers and air chambers (dummy channels), which do not eject ink and provided on least at both neighboring sides of each pressure chamber, are arranged. By this arrangement, the influence of the pressure chamber having ejected an ink droplet is prevented from transferring to the neighboring chamber. In this case all pressure chambers can eject ink droplets at the same timing. The present invention can be applied to any of the above methods, however, the latter method (dummy channel method) is more preferable since the ink droplets can be more stably ejected.

Figure 4A:
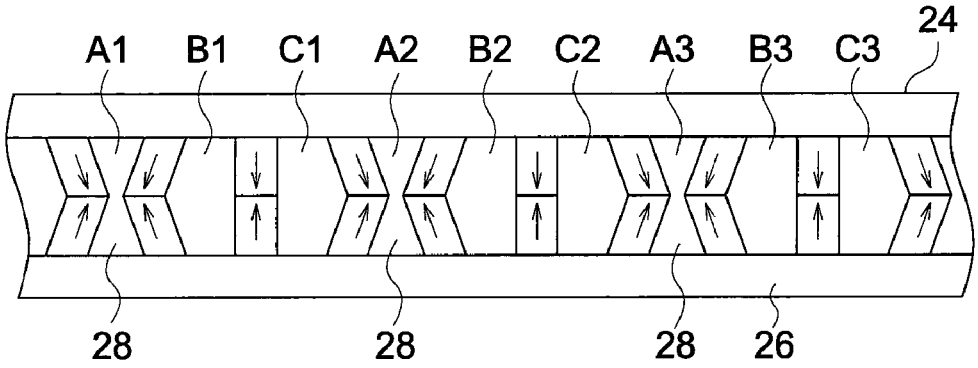
FIGS. 4*a* to 4*c* are explanatory drawings of time-division operations of the recording head.
Figure 4B:
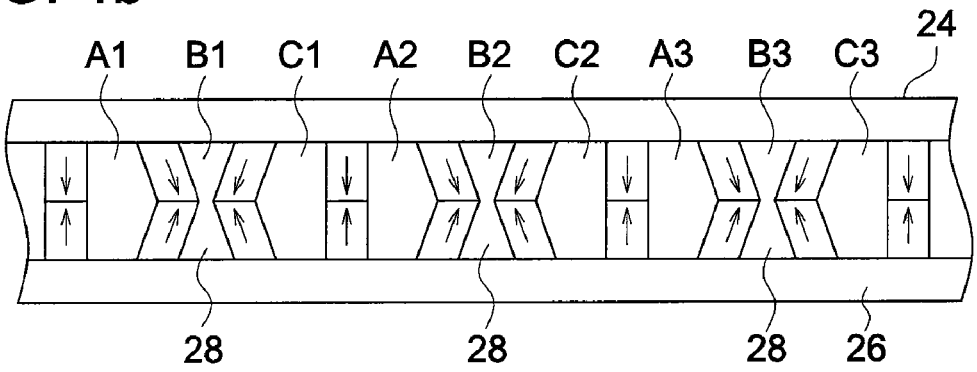
Figure 4C:
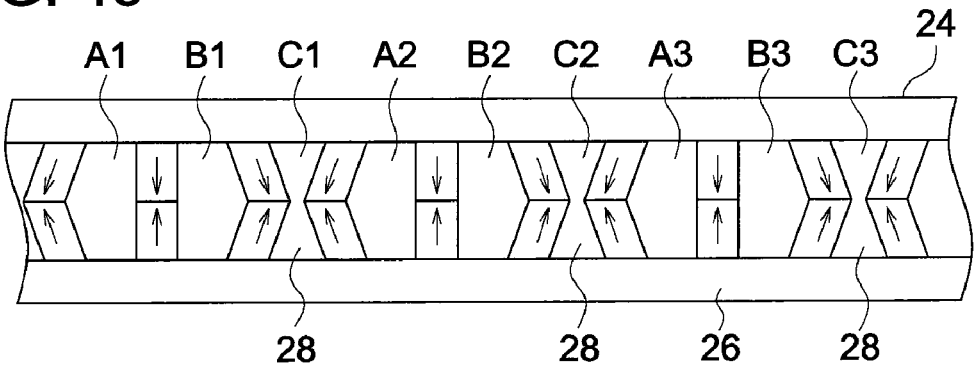

The 3-cycle ejection operation will be further explained referring to FIGS. 4*a*-4*c*, assuming that the recording head contains nine pressure chambers 28 (A1, B1, C1, A2, B2, C2, A3, B3, and C3). FIG. 5 shows a timing diagram of drive pulses to be applied to electrodes of pressure chambers of each group of chamber 28, A, B, and C.

At the time of ejection, voltages are applied to electrodes of respective pressure chambers 28 of group A (A1, A2, and A3), while the electrodes of the pressure chambers of neighboring groups B and C are grounded. By applying the preliminary pulse and the ejection pulse to the pressure chamber of group A, a minute ink droplet is ejected from the pressure chamber of group A which is expected to eject ink.

Similarly, pressure chambers 28 of group B (B1, B2, and B3) and group C (C1, C2, and C3) are operated in sequence.

Figure 6:
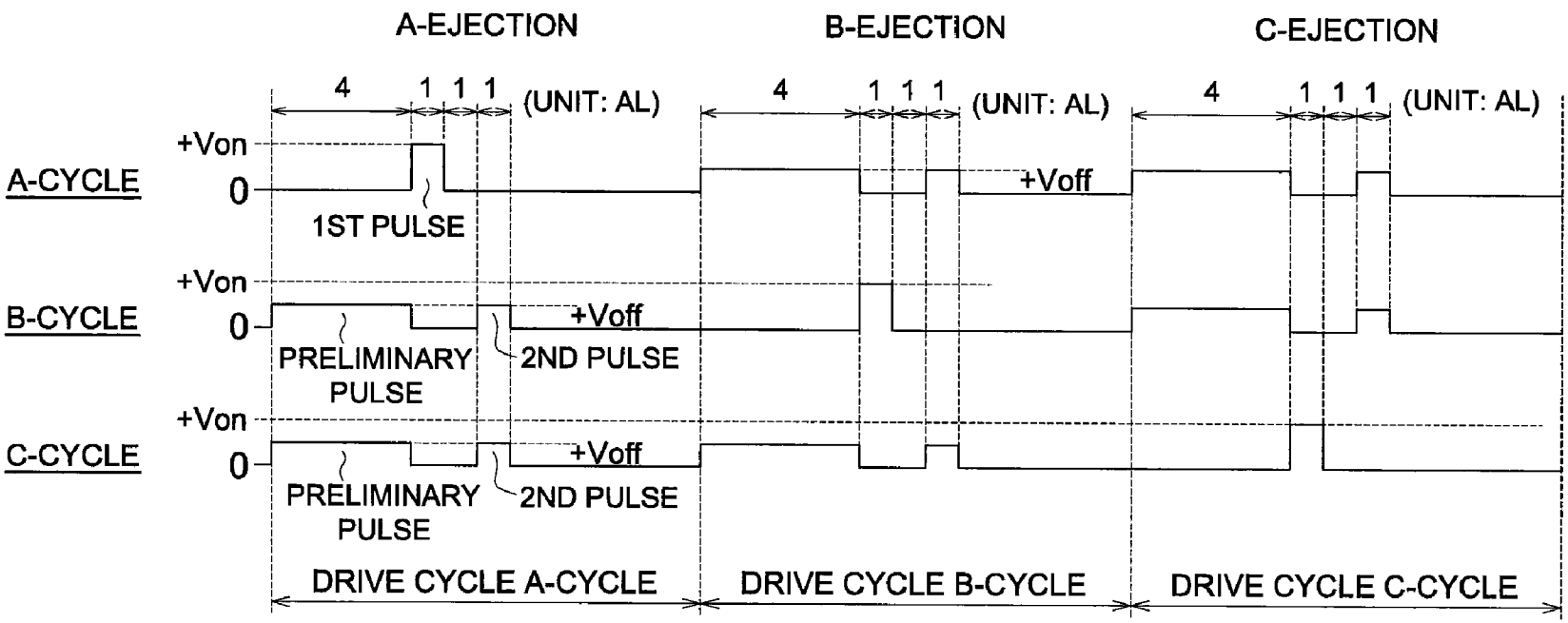
FIG. 6 shows a timing diagram of drive signals using only positive voltages.

The above shear-mode ink jet recording head deforms partition walls 27 by the difference of voltages applied to electrodes provided on both sides of each partition wall. Therefore, instead of applying a negative voltage to the electrode of a pressure chamber to eject ink, the similar operation can be attained by grounding the electrode of a pressure chamber which is to eject ink and applying a positive voltage to electrodes of the neighboring pressure chambers as shown in FIG. 6. According to the latter method, in addition to achieving the same effect as in the case of applying the drive signals shown in FIG. 5, the circuit for generating the drive signals can be configured only with positive voltages, which is preferable viewing from the point of a simpler circuit design.

Next, referring to FIG. 7, operation of applying micro-vibrations to the meniscus in the nozzle of a pressure chamber, not in use for ejecting an ink droplet in an image recording area, will be described with the use of recording head 2 of the shear mode system. In the explanation here, the above mentioned 3-cycle driving method is applied. Here the case is explained where any of pressure chambers groups A, B and C does not eject the ink droplet, while micro-vibrations are applied to the pressure chambers in the sequence of groups A→B→C.

In the present embodiment, as the micro-vibration pulse which causes micro-vibrations, but not to the extent of ejecting the ink droplet from the nozzle, any one of or both of the preliminary pulse and the second pulse is applied to the pressure chamber. Here, the preliminary pulse and second pulse shown in FIG. 6 are utilized. The micro-vibration pulse is preferably configured with a rectangular wave.

By using the rectangular pulse as the micro-vibration pulse, the efficiency of causing micro-vibration to the meniscus is higher than the case of using a trapezoidal wave, the micro-vibration is caused with a lower drive voltage, and the drive circuit can be designed as a simpler digital circuit.

Figure 7:
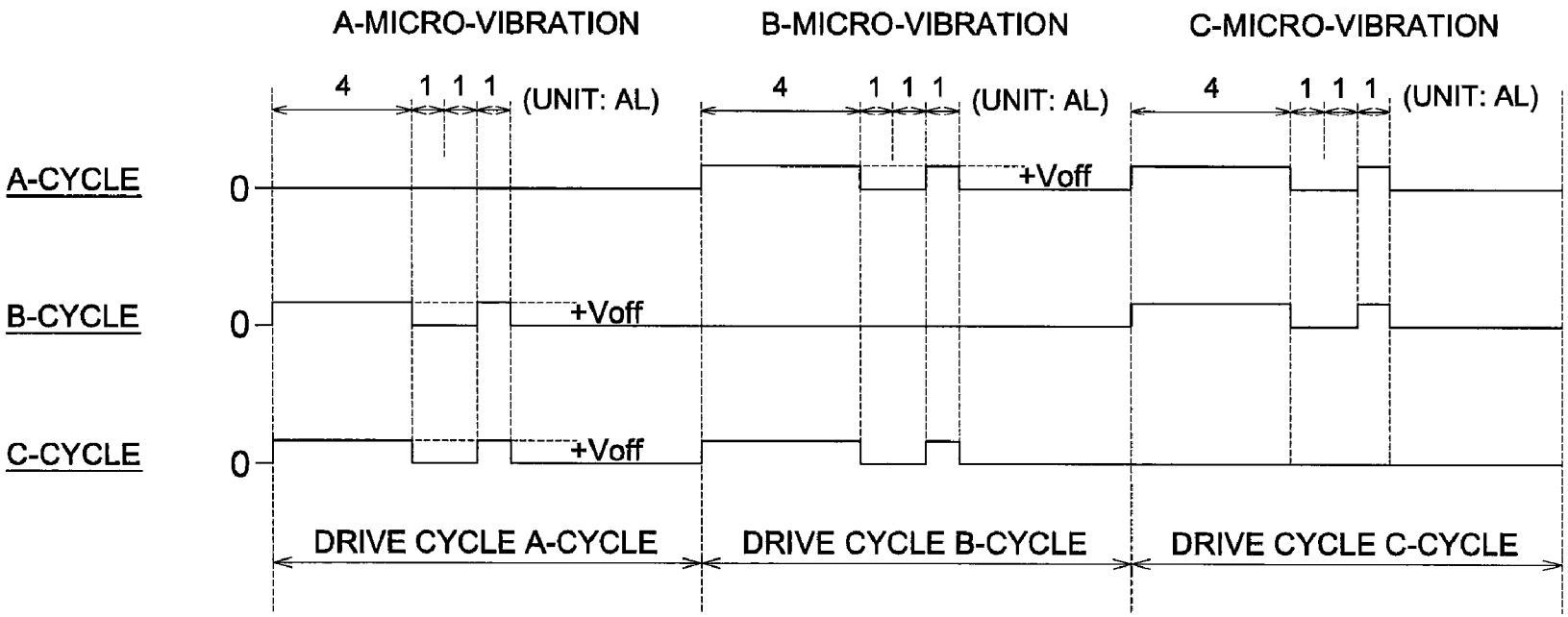
FIG. 7 shows a timing diagram of drive signals to be applied to pressure chambers of each groups A, B, and C, at the time of micro-vibration in meniscus for non-ejection pixels.

For instance in the example shown in FIG. 7, in the imaging area, firstly the electrodes of group A pressure chambers are grounded, and on the electrodes of groups B and C pressure chambers applied are the preliminary pulse having a rectangular wave with positive voltage and a width of 4 AL, and the second pulse having a rectangular wave with positive voltage and a width of 1 AL. By this, the meniscus in the nozzle of A group pressure chambers are given micro-vibrations to push the meniscus to the extent of not ejecting the ink droplet from the nozzle, while each pressure chamber of groups B and C is deformed such that only one of partition walls constituting a pressure chamber is shifted to cause a micro-vibration with half the strength of that in group A pressure chamber.

In the case where micro-vibration of the group A pressure chamber is terminated, and the group B pressure chamber is successively given micro-vibrations, firstly the electrodes of group B pressure chambers are grounded, and on the electrodes of groups A and C pressure chambers applied are the preliminary pulse, having a positive voltage rectangular wave and width 4 AL, and the second pulse having a positive voltage rectangular wave and width of 1 AL. Application of the preliminary pulse and the second pulse to the group C pressure chambers to cause the micro-vibrations is similarly performed.

A selecting method of drive pulses in each pixel will be explained by referring to FIGS. 8 and 9. ON waveform and OFF waveform in FIGS. 8 and 9 indicate two types of drive signals generated by a drive signal generating circuit.

The OFF waveform in the drive signals corresponds to both the preliminary pulse and the second pulse of the ejection pulse, and ON waveform corresponds to the first pulse of the ejection pulse. Although not illustrated, GND (ground potential) can be also selected as the ON waveform. Since the drive voltage of the preliminary pulse is set to be identical to the drive voltage Voff of the second pulse composing the ejection pulse, the ON waveform and OFF waveform can be generated only by digitally switching the respective single power source voltages of Von and Voff.

The ON waveform and OFF waveform are respectively supplied to a drive pulse selection circuit of each pressure chamber, and are selectively supplied to the electrode of each pressure chamber by the control of a pulse selection gate signal based on image data for each pressure chamber.

The drive pulse selection circuit supplies an ON waveform or GND (ground potential) when the pulse selection gate signal is "High", and supplies an OFF waveform when the pulse selection gate signal is "Low". Specifically, in the case where pulse selection gate signal is High, the circuit supplies ON waveform to ejection pixels (printing pixels) and supplies GND to non-ejection pixels (non-printing pixels).

The case where every pressure chamber of groups A, B, and C eject ink droplets will now be explained by using FIG. 8.

Since the 3-cycle drive method is applied, firstly image data is supplied to the pressure chamber of group A which being in ejection timing, and the pulse selection gate signal turns High, while as for the pressure chambers of groups B and C which are not in ejection timing, no image data is supplied and the pulse selection gate signal turns Low. Next, image data is supplied to the pressure chamber of group B which being in ejection timing, and the pulse selection gate signal turns to High, and as for the groups A and C pressure chambers which are not in the ejection timing, no image data is supplied and the pulse selection gate signal turns to Low. Then, image data is supplied to the group C pressure chamber which being in ejection timing, and the pulse selection gate signal turns to High, and as for the groups A and B pressure chambers which are not in the ejection timing, no image data is supplied and the pulse selection gate signal turns to Low. From then on, similar operations are repeated.

Figure 8:
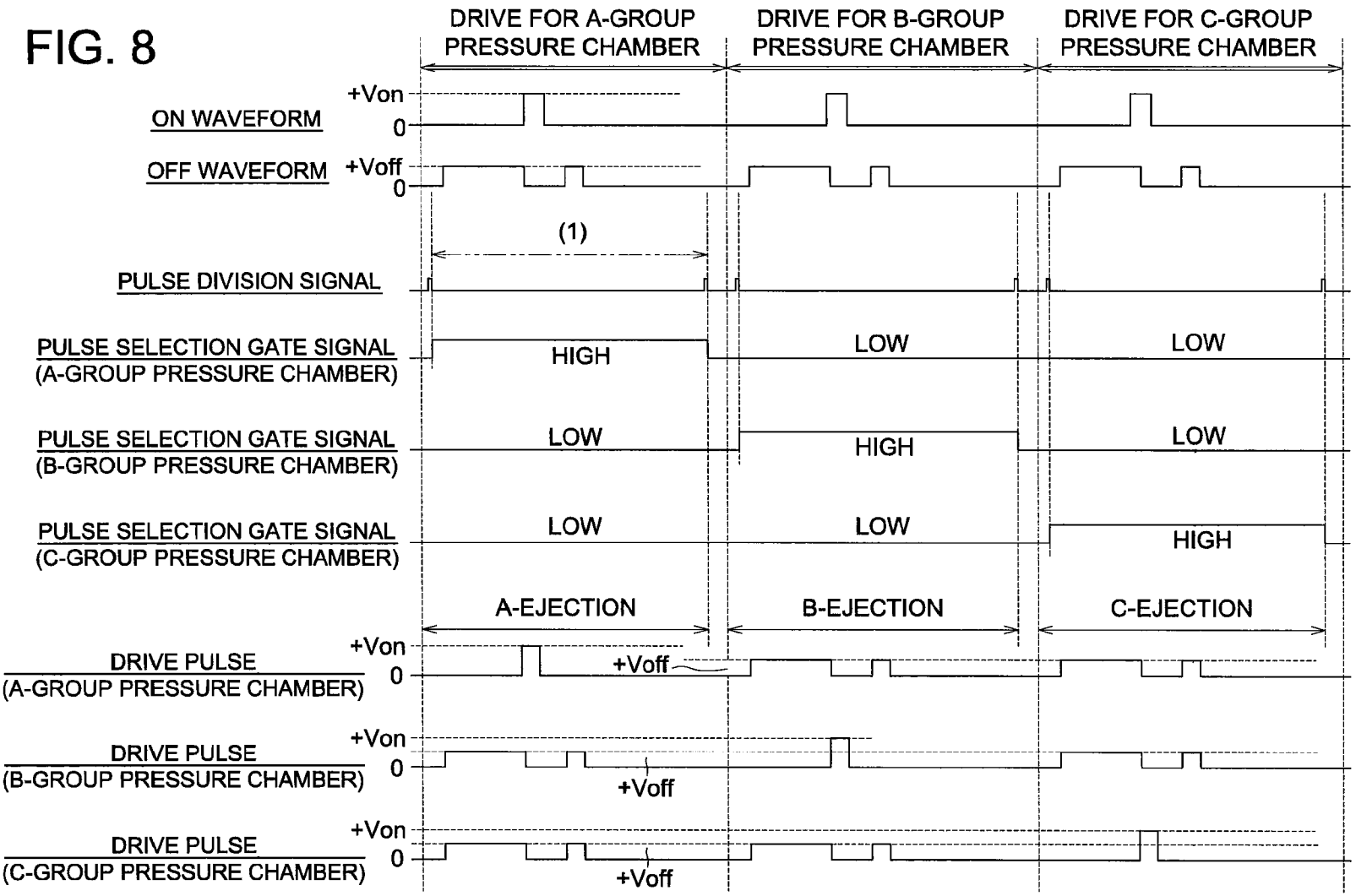
FIG. 8 shows a timing diagram of drive signals in the case where a preliminary pulse and an ejection pulse are selectively applied to pressure chambers of each groups A, B, and C.

FIG. 8 illustrates one drive cycle of each of groups A, B, and C pressure chamber of. In the following, an example of drive timing of group A pressure chambers will be described.

In the time period before applying the preliminary pulse and the period after applying the ejection pulse, pulse division signals are respectively applied. When image data for ejection is supplied to a pixel, accordingly the pulse selection gate signal synchronized with the pulse division signal turns to High. During the period when the pulse selection gate signal corresponding to group A pressure chambers is set at High ((1) in FIG. 8), an ON waveform of the drive signal is applied to the electrode of group A pressure chambers. At that time, since the pulse selection gate signals corresponding to pressure chambers of groups B and C are Low, OFF waveforms are applied to the electrodes of pressure chambers of groups B and C, both sides partition walls are deformed, and ink droplets are ejected from the nozzles of group A pressure chambers. The drive timing of groups B and C pressure chambers is similar to the above.

Figure 9:
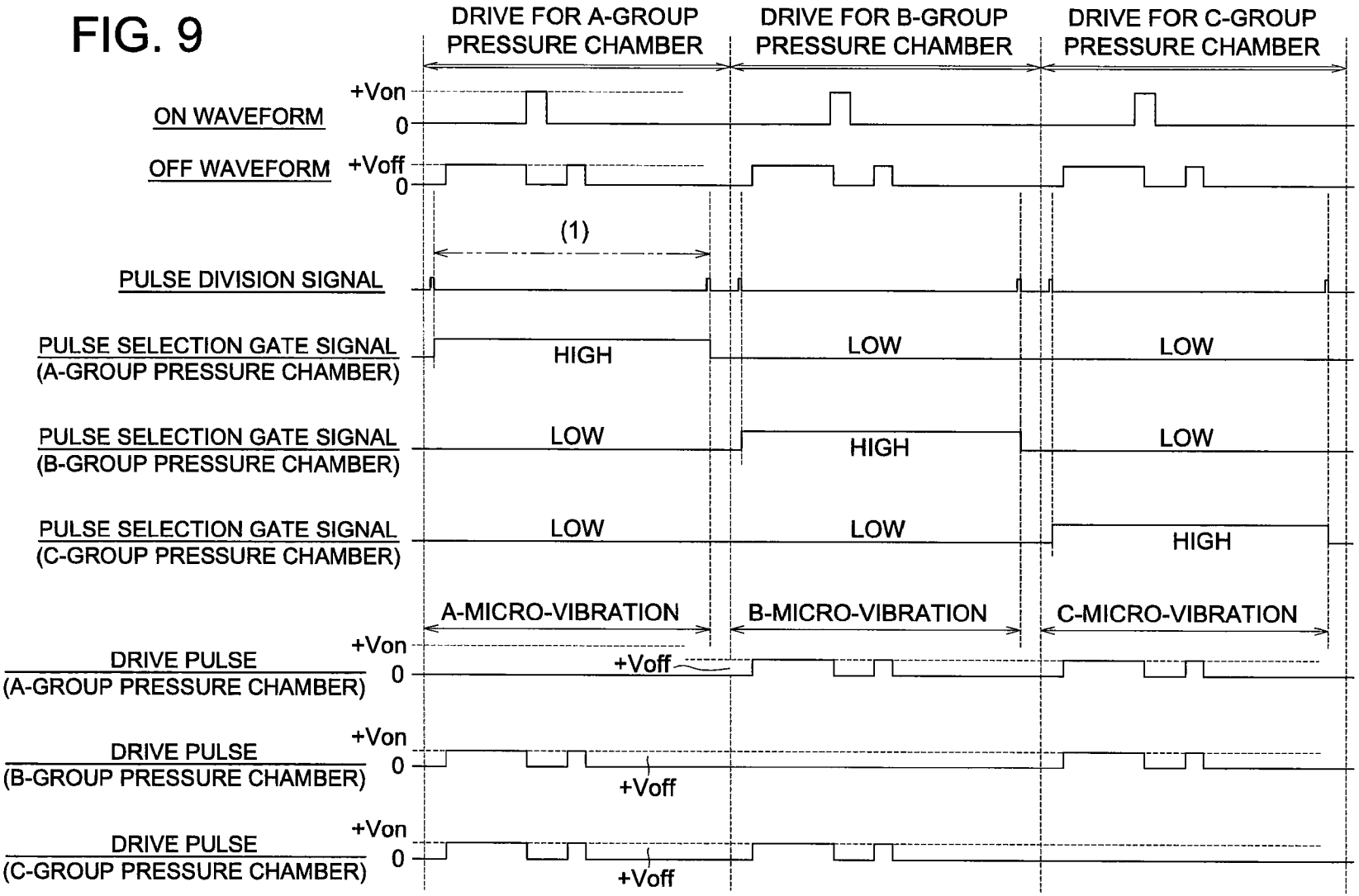
FIG. 9 shows a timing diagram of drive signals in the case where a preliminary pulse and an ejection pulse are selectively applied to pressure chambers of each group (A, B, and C)

Next, the case is explained referring to FIG. 9 where any of pressure chambers of groups A, B, and C do not eject ink, and micro-vibrations are given to the pressure chambers in the order of: group A→group B→group C.

During the period before applying the preliminary pulse and the period after applying the ejection pulse, pulse division signals are respectively applied. When image data for non-ejection is supplied for a pixel, the pulse selection gate signal synchronized with the pulse division signal turns to High. In the period when the pulse selection gate signal corresponding to group A pressure chamber is High ((1) in FIG. 9), GND as the drive signal is applied to the electrode of group A pressure chamber. At this time, since the pulse selection gate signals corresponding to groups B and C pressure chambers are at Low, OFF waveforms are applied to the electrodes of groups B and C pressure chambers, both sides partition walls are deformed, and micro-vibration is given to the ink meniscus in the nozzle of group A pressure chambers. The drive timing in groups B and C pressure chambers is similar to the above.

In this way, by constantly applying an OFF waveform even to the non-ejection pixels, any increase of ink viscosity in the vicinity of the nozzle opening can be effectively suppressed.

Further, by utilizing the preliminary pulse and the second pulse as the micro-vibration pulse, and setting the drive voltage of micro-vibration pulse to be low voltage of Voff, no excessive micro-vibration is applied, and the micro-vibration with the level of not to eject an ink droplet from the nozzle can be effectively given to the ink meniscus.

In the above description, the case is explained where the micro-vibration pulse composed of the preliminary pulse and the second pulse is outputted from drive signal generating section 100 to the electrode on partition wall of each pressure chamber for non-ejection of the ink droplet corresponding to non-ejection pixel in the image recording area. However, in the example of the first embodiment, it is preferable to similarly output the micro-vibration pulse from drive signal generating section 100 even outside the image recording area.

For example, in addition to outputting the micro-vibration pulse in the image recording area on a recording sheet, the micro-vibration pulse is also outputted outside the image recording area.

By this, drying of the ejection nozzle at outside the image recording area can be effectively prevented so that reliable ink droplet ejection from the starting point of each recording line can be achieved.

Since the basic drive method of the recording head outside the image recording area is similar to that in the image recording area, such explanation is omitted. Since there is no image data for outside the image recording area, for example when the recording head is at the waiting position, by applying the micro-vibration pulse shown in FIG. 7 to cause micro-vibrations to all the nozzles, ink viscosity at nozzle surfaces is prevented from increasing. Each ink droplet can be stably ejected from the first droplet of each line.

On the return of each reciprocal movement of the carriage, if it is only the movement without image recording, only the micro-vibration pulse is outputted from drive signal generating section 100. In the case of executing image recording in addition to the return movement, the similar operations as in the embodiment described above are applied.

The ejection pulse and the preliminary pulse in the above described embodiment can be other waveforms. Examples are shown in FIGS. 10*b* and 10*c*, and 10*e* and 10*f*.

For example, as for the ejection pulse, the requisite is only to have a first pulse which contracts the pressure chamber after expanding it. The pulse shown in FIG. 10*e*, which applies the second pulse to expand the volume of the pressure chamber after contracting subsequently to the first pulse, or the pulse shown in FIG. 10*f* can be applied which is a single polarity ejection pulse to eject the droplet only by the first pulse.

Figure 10E:
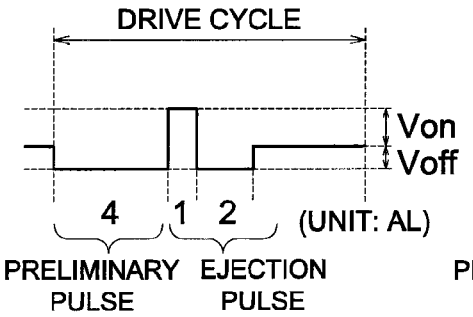
Figure 10F:
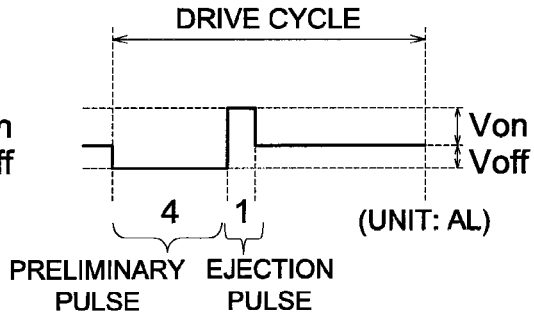

In the case of FIG. 10*e*, the micro-vibration pulse is composed of the preliminary pulse with pulse width of 4AL, and the second pulse with pulse width of 2AL. In the case of FIG. 10*f*, the micro-vibration pulse is composed of only the preliminary pulse with pulse width of 4AL.

As for the preliminary pulse, required is a rectangular pulse having the pulse width of 2AL or greater, therefore the pulse width can be 2AL or 3AL as shown in FIGS. 10*b* and 10*c*.

The width of the preliminary pulse is preferably 10AL or less from the point of performing high frequency drive, and width of greater than 3AL is preferable to enforce the effect of reducing the droplet size, as well as to reduce the drive voltage. Therefore, the preliminary pulse width of 3.5AL through 6AL is preferable from the points of small droplet size, low drive voltage and high frequency drive. And the preliminary pulse width of 3.5AL through 4.5AL is further preferable.

EXAMPLE

Hereinafter, examples of the present invention will be described, however the present invention is not restricted to these examples.

Example 1

Figure 12:
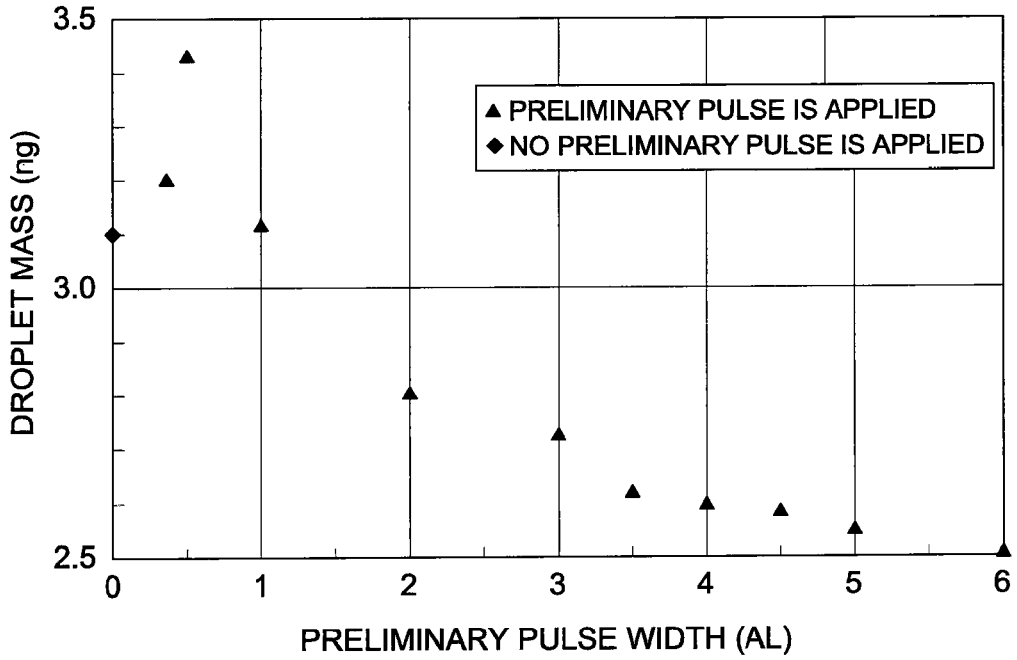
FIG. 12 is a graph showing a relationship between preliminary pulse width and droplet mass.
Figure 13:
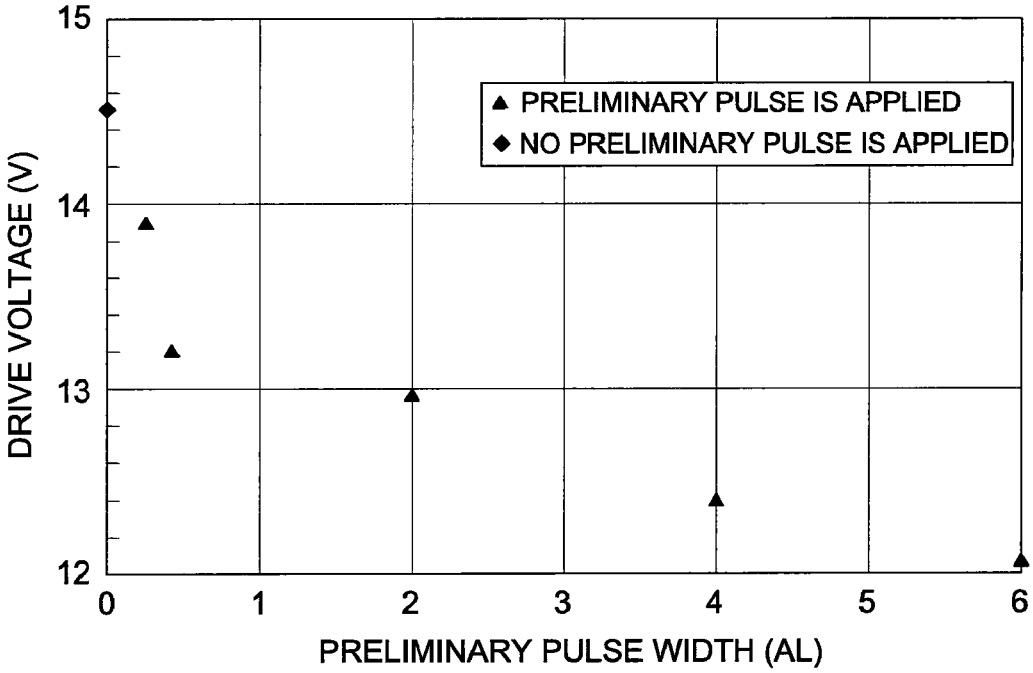
FIG. 13 is a graph showing a relationship between preliminary pulse width and drive voltage.

In the recording head of a shear mode system shown in FIG. 2 (number of nozzles: 256, nozzle diameter: 23 μm, AL: 3.0 μs), by dividing each pressure chamber into three groups, while varying the pulse width of the preliminary pulse as shown in FIGS. 12-13 on the basis of the dive signal shown in FIG. 6, ink droplets are ejected with the drive voltage to control the flying speed of the ejected ink droplet to 6 m/s, and the mass of the ejected ink droplet are measured.

Herein, the ejection pulse is, as shown in FIG. 6, composed of a first pulse which, after expanding the volume of the pressure chamber, contracts it to its original volume, and the second pulse, which is a rectangular wave to be applied after a period of 1AL from the first pulse, and after contracting the volume of the pressure chamber, expands to its original volume, wherein each pulse width of the first pulse and the second pulse is 1AL.

Ink: pigment ink of solvent system; Viscosity, 6.0 mPa·s; Surface tension, 35.5 mN/m at 25° C.

Drive cycle: 15AL;

Drive voltage ratio: $|Von|/|Voff|=2$;

Measurement Method of Droplet Mass:

Under conditions where the pulse width of preliminary pulse is varied, by ejecting 125,000 shots of droplets, measuring the total weight of the ink obtained from the droplets, whereby the mass per droplet is calculated.

With respect to the result of the above, a graph representing the relationship of the preliminary pulse width and the droplet mass is shown in FIG. 12, while a graph representing the relationship of the preliminary pulse width and the drive voltage (Von) that makes the flying speed of ink droplet to be 6 m/s is shown in FIG. 13. As shown in FIG. 12, under the condition of present invention where the width of preliminary pulse is 2AL or more, it is confirmed that the droplet mass is remarkably reduced.

Further confirmed is that, as shown in FIG. 13, under the conditions of present invention where the width of preliminary pulse is 2AL or more, the effect of reducing the drive voltage is achieved, and in the case where the preliminary pulse width is 4AL, the effect of further reducing the drive voltage is achieved.

Example 2

Figure 11:
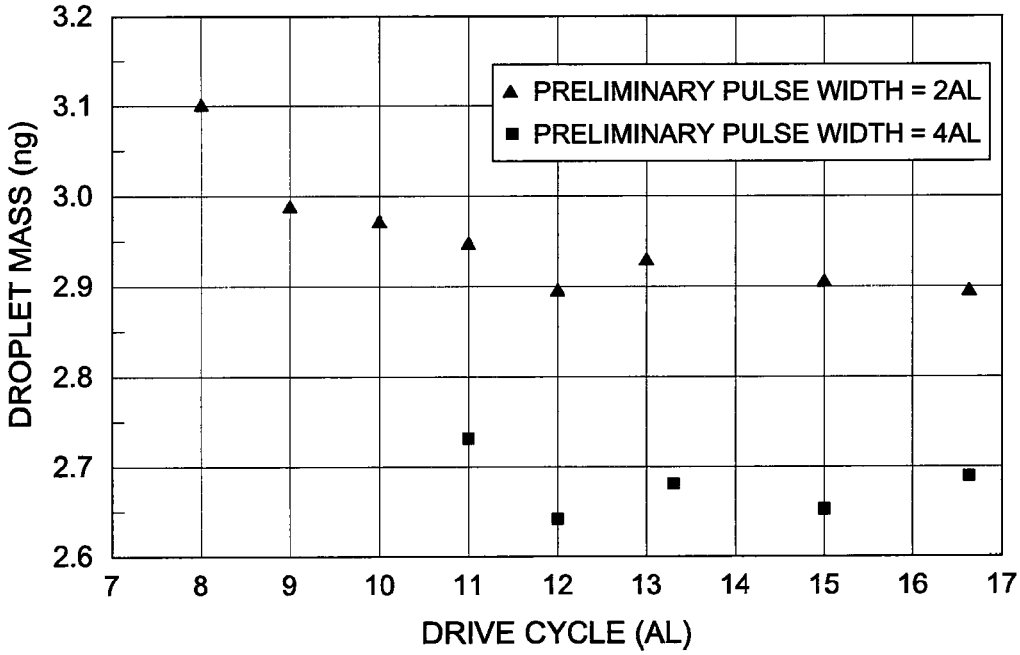
FIG. 11 is a graph showing the relationship between drive cycle and droplet mass.

By using the same recording head and ink as Example 1, setting the preliminary pulse width as 2AL or 4AL, the droplet mass is measured similarly to example 1, in cases where drive cycle is varied as shown in FIG. 11.

A graph representing the relationship of the drive cycle and the droplet mass is shown in FIG. 11.

As shown in FIG. 11, the tendency that the longer the duration of the drive cycle becomes, the smaller the droplets becomes, and confirmed are that in any drive cycle, the droplet mass is more reduced (more than 7%) with the preliminary pulse at a width of 4AL than in the case of 2AL.

Example 3

Figure 14:
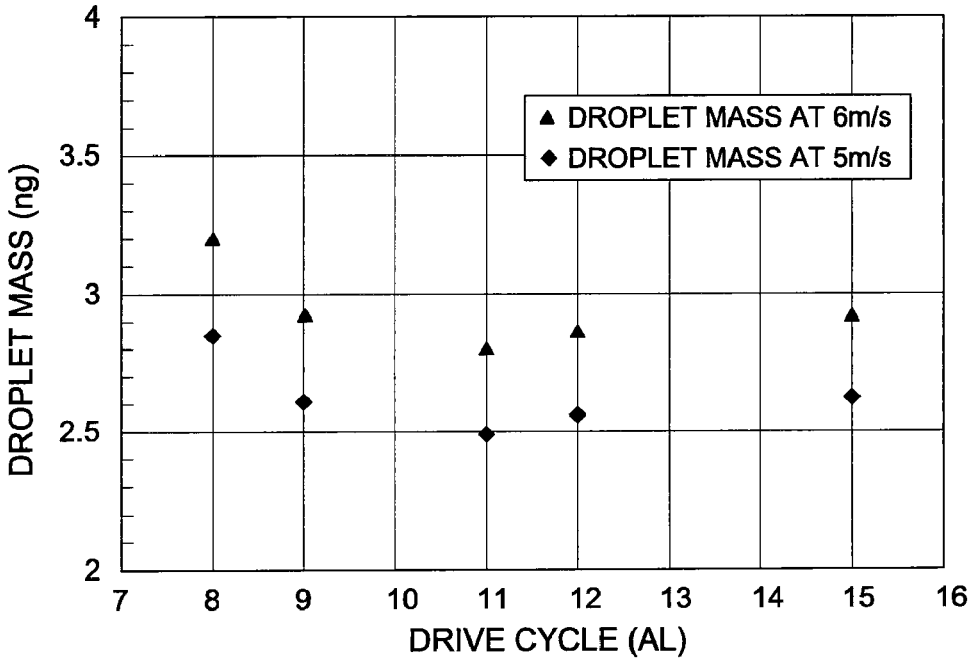
FIG. 14 is a graph showing a relationship between drive cycle and droplet mass.

By using the same recording head as Example 1, using a water-based pigment ink, setting the preliminary pulse width as 4AL, the droplet mass is measured similarly to the example 1, in cases where flying speed being 5 m/s and 6 m/s, and drive cycle is varied as shown in FIG. 14.

A graph representing the relationship of the drive cycle and the droplet mass is shown in FIG. 14.

As shown in FIG. 14, the tendency that the longer the drive cycle becomes, the smaller the droplets become, and confirmed is that in any drive cycle, the droplet mass is more reduced with the flying speed 5 m/s than in the case of 6 m/s.

Example 4

By using the same recording head and ink as in Example 1, setting the preliminary pulse width as 4AL, and executing the 3-cycle drive with the drive pattern shown in FIG. 7 where a micro-vibration pulse composed of the preliminary pulse and the second pulse is applied to the pressure chamber of non-ejection pixel, and after that the drive signal shown in FIG. 6 is applied to eject ink droplets from every nozzles. The improvement effect of the decap property is evaluated in low temperature low humidity circumstances at 11° C., 35% RH.

The decap property is measured with respect to an arbitrary nozzle with the method described below.

Measuring Method of Decap Property:

By using the same recording head and ink as in Example 1, fixing the drive voltage (Von=12.4V) which makes the flying speed of the ink droplet at normal drive mode to be 6 m/s, and change of initial ejection speed of the droplet is measured while ejecting the ink droplet by increasing the number of non-ejection pixels, in a condition where the micro-vibration pulse is not applied to non-ejection pixels and after that the ink droplets are ejected, and in another condition where the micro-vibration pulse is applied onto the non-ejection pixels and after that the ink droplets are ejected. In this measurement, it is regarded that the smaller the flying speed change is, the lager improvement effect of the decap property is obtained.

In the case of not applying the micro-vibration pulse to the non-ejection pixel, the flying speed of the initial ejected droplet was largely decreased in accordance with the increase of the number of non-ejection pixels.

In the case of applying the micro-vibration pulse to the non-ejection pixel, the flying speed of the initial ejected droplet was approximately 6 m/s and was not decreased even with the increase of the number of non-ejection pixels. By this, confirmed is that applying the micro-vibration pulse to the non-ejection pixel is effective for preventing the decap phenomenon in low-temperature low-humidity circumstances. Further, in this case the droplet mass was 2.6 ng, and was same as the constant drive situation.

By applying the micro-vibration pulse for the non-ejection pixels, even in the pattern of ejecting only at edge portion of the image recording area, stable droplet formation is enabled. Further, also in the case of using the water-based pigment ink same as in Example 3, the similar result was obtained.

What is claimed is:

1. An inkjet recording method for utilizing a recording head having a pressure chamber and a pressure generation device to change a volume of the pressure chamber, and ejecting an ink in the pressure chamber as an ink droplet from a nozzle by driving the pressure generation device, the method comprising:

applying, to the pressure generation device, an ejection pulse including a first pulse for expanding a volume of the pressure chamber and then contracting the volume, and applying a second pulse after an interval of 1AL time period from the first pulse, for contracting the volume of the pressure chamber and then expanding the volume; and applying, to the pressure generation device, a preliminary pulse immediately before the first pulse without an interval between the preliminary pulse and the first pulse, for contracting the volume of the pressure chamber and then expanding the volume, wherein the preliminary pulse is a rectangular wave having a pulse width of 2 AL or greater, where AL is ½ of an acoustic resonance cycle period of a pressure wave in the pressure chamber.

2. The inkjet recording method of claim 1, wherein the pulse width of the preliminary pulse is not less than 3.5 AL and not greater than 6 AL.

3. The inkjet recording method of claim 2, wherein the pulse width of the preliminary pulse is not less than 3.5 AL and not greater than 4.5 AL.

4. The inkjet recording method of claim 1, wherein a drive voltage Von of the first pulse and a drive voltage Voff of the preliminary pulse are set to be $|Von|>|Voff|$.

5. The inkjet recording method of claim 4, wherein the drive voltage Von of the first pulse and the drive voltage Voff of the preliminary pulse are set to be $|Von|/|Voff|=2$.

6. The inkjet recording method of claim 1, wherein a drive voltage of the second pulse is identical to a drive voltage Voff of the preliminary pulse.

7. The inkjet recording method of claim 1, further comprising applying, to the pressure generating device of the pressure chamber, at least one of the preliminary pulse and the second pulse to cause a micro-vibration in an ink meniscus in the nozzle which does not cause ejecting of the ink droplet from the nozzle, when the ink droplet is not ejected.

8. The inkjet recording method of claim 1, further comprising applying, to the pressure generating device of the pressure chamber which is not to eject the ink droplet in an image recording area, at least one of the preliminary pulse and the second pulse to cause a micro-vibration in an ink meniscus in the nozzle which does not cause ejecting of the ink droplet from the nozzle, when the ink droplet is not ejected.

* * * * *